United States Patent [19]

Holley

[11] 4,085,780

[45] Apr. 25, 1978

[54] LIQUID DISPENSING MEANS

[75] Inventor: John Ernest Foster Holley, Westerham, England

[73] Assignee: Lever Brothers Company, New York, N.Y.

[21] Appl. No.: 621,797

[22] Filed: Oct. 14, 1975

[30] Foreign Application Priority Data

Oct. 14, 1974 United Kingdom ..... 44493/74

[51] Int. Cl.[2] ..... B65B 3/04

[52] U.S. Cl. ..... 141/1; 141/270; 141/238; 141/311 R

[58] Field of Search ..... 141/1, 279, 140, 141, 141/156, 157, 164, 190, 191, 249, 270, 284, 311, 387, 388, 374, 250; 417/474, 476; 222/420, 421, 422; 34/5; 141/392, 234–246

[56] References Cited

U.S. PATENT DOCUMENTS

| | | | |
|---|---|---|---|
| 1,393,276 | 10/1921 | Fuller | 141/181 |
| 2,699,717 | 1/1955 | Moreland et al. | 141/181 |
| 3,165,386 | 1/1965 | Kapeker | 34/5 |
| 3,327,898 | 6/1967 | Farr | 222/420 |
| 3,328,937 | 7/1967 | Newman et al. | 141/186 |
| 3,450,173 | 6/1969 | Maizel | 222/420 |
| 3,476,291 | 11/1969 | Glaser | 222/420 |
| 3,683,977 | 8/1972 | Crovye et al. | 141/181 |
| 3,933,187 | 1/1976 | Marlinski et al. | 141/392 |
| 3,935,885 | 2/1976 | Alter | 141/279 |

*Primary Examiner*—Houston S. Bell

*Attorney, Agent, or Firm*—Hill, Gross, Simpson, Van Santen, Steadman, Chiara and Simpson

[57] ABSTRACT

Antibiotic liquids of different concentrations are dispensed to wells of a multi-well tray through an array of nozzles connected to an array of perstaltic pumps operated to supply predetermined quantities of the liquids in co-ordination with upward movement of a support for the multi-well tray from a loading position. A suspended drop of liquid is formed at each nozzle and the drops are dispensed by contact between the wells and the drops.

12 Claims, 2 Drawing Figures

LIQUID DISPENSING MEANS

This invention relates to an apparatus for and a method of dispensing liquid to wells of a multi-well tray and also to a tray having liquid dispensed thereto in accordance with the method.

The invention is particularly relevant to the dispensing of minute quantities or droplets of liquid, for example antibiotic liquids, to the wells of a multi-well test tray designed for the analysis of minimal inhibitory concentration in micro-biological subjects.

Such multi-well trays have, for example, twelve rows each comprising eight wells and are prepared by inserting into the wells of successive rows antibiotic liquid of successively decreasing concentrations so that the inhibitory effect of the successive concentrations can be observed after drops of a culture have been inserted into each well. The preparation of the wells for this purpose is at present a slow and expensive operation in which antibiotic liquid of major concentration is successively diluted for insertion in successive rows of wells in a tray.

The invention is accordingly concerned with the provision of an apparatus for and a method of dispensing liquid to wells of a multi-well tray in a quick and inexpensive way.

The invention therefore provides an apparatus for dispensing liquid to wells of a multi-well tray, the apparatus comprising a two-dimensional array of nozzles each connected to a respective one of an array of pumps, each pump being operable to supply a predetermined quantity of liquid from a source thereof, a support for supporting a multi-well tray, and means for relatively moving the array of nozzles and the support between a first position for loading and unloading of a tray and a second position in which each well of a tray on the support is located to receive the predetermined quantity of liquid from a respective one of the nozzles.

The invention also provides a method of dispensing liquid to wells of a multi-well tray, the method comprising the steps of relatively moving the tray and an array of nozzles from a first position for loading of the tray to a second position in which each nozzle is located in registration with a respective one of the nozzles, a predetermined quantity of liquid from a respective one of an array of pumps being supplied to each of the nozzles for reception by the associated well in the second position, and relatively moving the tray and the array of nozzles to the first position for unloading of the tray.

By way of illustration, an apparatus embodying the invention and capable of performing the method thereof is described below with reference to the accompanying drawings, in which.

Figure 1:
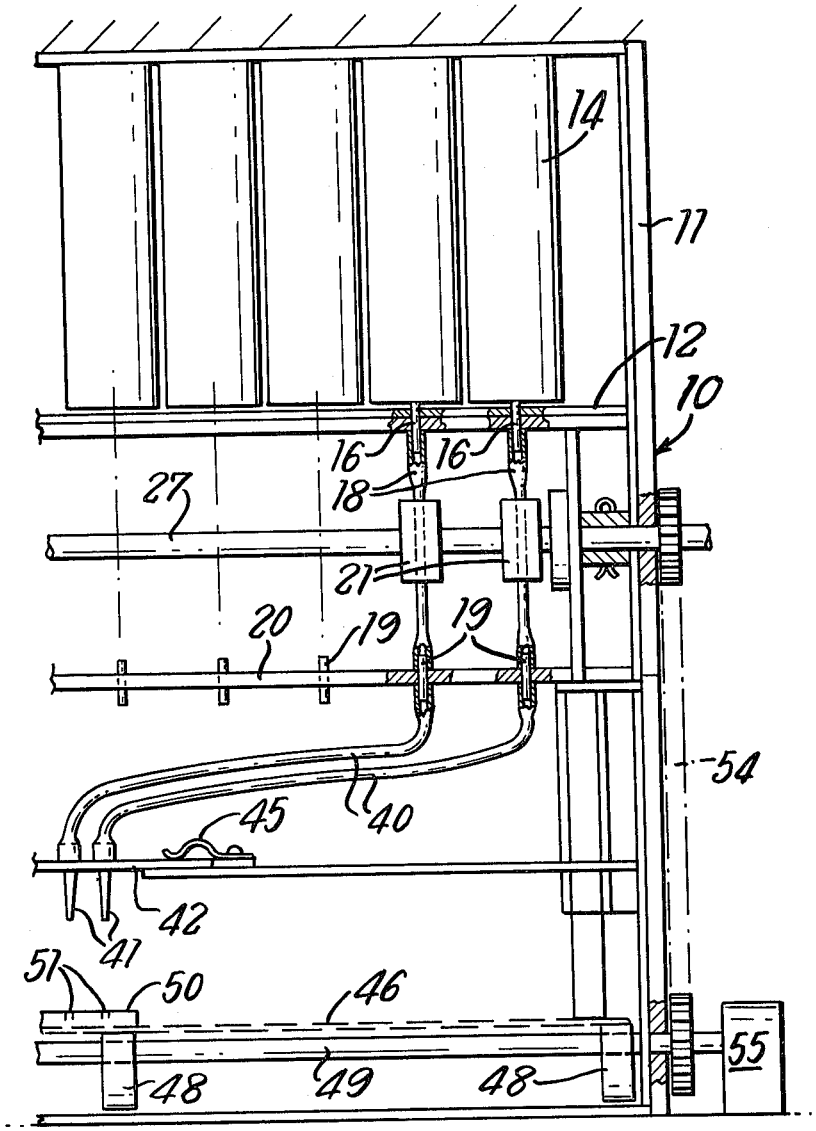
FIG. 1 shows the apparatus schematically and in elevation.

The illustrated apparatus 10 comprises a frame 11 mounting at the top thereof a support 12 for carrying twelve rows each of eight tubular containers 14. The containers 14 are of a size to contain, say, 50 milliliters of liquid. Each of the containers 14 has an outlet connector 16 at its lower end, the connectors being adapted for attachment to downpipes 18 of non-reactive rubber, plastics, or metal tubing. The lower ends of the downpipe 18 are connected to respective ones of a two-dimensional array of ninety-six pumps 21. The pumps 21 are preferably of the peristaltic type, that is, each pump comprises a length of compressible tube into which the liquid is introduced, the tube being associated with means for segregating the contents of successive equal lengths of the tube and for discretely ejecting each segregated volume of the liquid from the outlet end of the tube.

Figure 2:
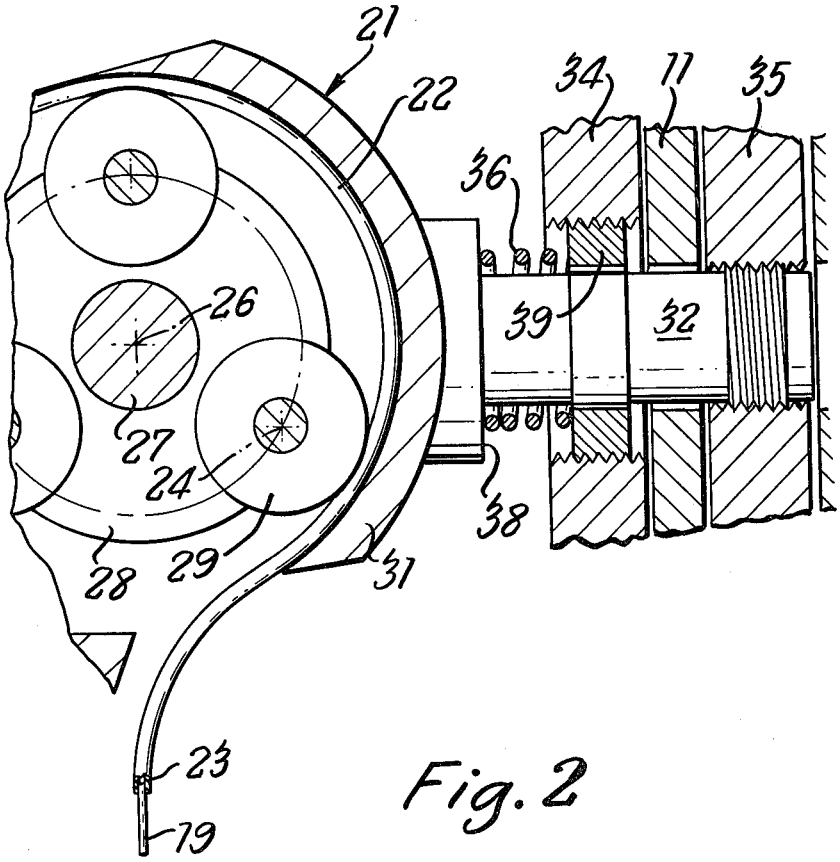
FIG. 2 is a sectional schematic view of a pump included in the apparatus of FIG. 1.

Referring to FIG. 2, each pump 21 comprises three rollers 29 carried for free rotation by a cage 28 on a rotatable shaft 27. Two or more than three rollers can be used were appropriate. The roller axes 24 are parallel to and at equal radial distances from the axis 26 of the shaft and are spaced equiangularly from one another. The compressible tube 22 extends over a segment of the periphery of the case 20 for engagement with the rollers 29. An arcuate support 31 with an inner surface of substantially the same diameter as the outer circular envelope of the path of travel of the rollers 29 is mounted to support the compressible tube 22 against the pressure of the rollers, of which at least two are within the arc of the support 31 at any time.

It is necessary for the rollers 29 to compress the tube 22 sufficiently to stop any flow of liquid through the tube, but not to flatten the tube. This is a critical condition and to adjust the pressure of the support 31 on the tube for this purpose an adjustment means is provided. This conveniently comprises a spring 36 urging the support 31 towards the rollers, the spring pressure being selectively adjustable. It is also necessary to be able to free the tube from pressure so that the apparatus can be sterilized, as in an autoclave, and a second adjustment means is advantageously provided, the first and second adjustment means affording respectively coarse and fine adjustment. The support 31 is mounted on a stem 32 the axis of which intersects the axis 26 and which extends away from the support through a tapped central aperture in a manually rotatable adjustment wheel 34 received in a part of the frame 11 substantially against axial movement. The compression spring 36 is received between a flange 38 on the stem 31 and an externally threaded washer 39 freely rotatably carried on the stem and meshing with the thread of the wheel 34. Rotation of the wheel 34 thus varies the spring tension to provide for fine adjustment. A screw-threaded portion of the stem 31 meshes with the thread of a second similarly arranged wheel 35, so that rotation of this wheel moves the stem and the support towards or away from the rollers 29 for coarse positioning and release of pressure on the tube 22.

Each of the rows of twelve containers 14 in the support 12 has underlying it a shaft 27 with twelve of the cages 28 secured to it or a single elongated cage with twelve sets of rollers 29 spaced along rigid spindles supported by spaced rotors. The downpipes 18 of the containers are connected to the collapsible tubes 22 of the pumps 21. The outlet ends 23 of the tubes 22 extend down to double ended connectors 19 mounted on a generally horizontal support plate 20 carried by the frame 11 below the array of pumps 21. At the underside of the plate 20, flexible tubes 40 lead from the lower ends of the connectors 19 to the inlet ends of a two-dimensional array of nozzles 41 having the form of hollow needles, the nozzles being mounted in a lower support plate 42 releasably secured within the frame 11 on inwardly projecting flanges 44 by clips 45.

The containers 14 and the array of pumps 21 occupy a larger area than the multi-well tray 50 the wells of which are to be filled from the nozzles 41 and it is necessary for the tubes 40 to convey the liquid doses from the outermost pumps 21 inwardly as shown. The nozzles 41 must register accurately with the wells of the tray 50 and the mounting of the plate 42 permits replacement so that the nozzles can be differently arranged for co-operation with a tray having different located wells.

Spaced below the support plate 42 is support 46 having surface formations for correctly locating the tray 50 thereon with the wells 51 thereof beneath the nozzles 41. The support 48 is guided in the frame 11 for vertically reciprocable movement caused by eccentric drive rollers 48 carried on a shaft 49. The eight shafts 27 and the shaft 49 are linked by a chain and sprocket or other drive linkage 54 so that all the shafts can be driven together from a single power source 55, which may be a one-tenth H.P. electric motor preferably with adjustable speed control. Because of the means provided for adjusting the pressures in the perstaltic pumps, the use of the freely rotating pump rollers 29, and the simple drive of the support 46, relatively little power is required for operating the apparatus. The operation of the pumps and the movement of the support 46 are co-ordinated so that a single dose of liquid is fed to the nozzles 41 for each upward movement of the tray 50.

The compressible tubing 22 used in the pumps 21 has a very fine bore so that a length subtending 300° at the axis 26 will contain only sufficient liquid to form a dependent droplet on the needle-point end of the nozzle 41 and for every 300° rotation of the pumps, the support 46 rises and falls once. Preferably, the upward movement of the support 46 raises the tray until the bottoms of the wells just touch the droplets formed on the ends of the nozzles after a dose of the liquid has been supplied by each pump, and each droplet is thereby detached into the respective well.

Conveniently, the nozzles 41 have a bell mouth on which the droplets form. The apparatus is so arranged that each droplet is smaller for example 25 lambda, than the maximum for example 50 lambda, the bell mouth is capable of supporting. The droplet is thus secure until touched by the bottom of a well.

A press-button drive control operates the motor 55 for one complete cycle of operation for processing a single tray, which is manually fed to and removed from the apparatus, either at one side or from one side to the other, through the apparatus. The feed through operation can be made semi-automatic by use of a reciprocating two-position tray support. An over-ride switch to allow continuous operation, one tray being filled for each 300° rotation of the pumps and fully automatic operation can be achieved by feed arrangements by which trays are pushed in turn from a storage stack into the processing position on a step-by-step conveyor, and then passed from the processing position to an output conveyor.

If the apparatus is used for preparing the trays for use in analytical medical laboratories, for example, the containers 14 will be charged with an antibiotic liquid in successively decreasing concentrations, liquid from each container being dispensed to a respective well of the tray. After reception of the antibiotic liquid, the tray can be given a protective cover and held for use within a day. To provide the tray with a longer shelf life, the liquid in the wells can be dried off by "dry freezing" techniques in which the tray is frozen and the temperature then gradually raised in vacuo, so that the ice sublimes and powdered antibiotic is left in the cells at ambient temperature. Adherent plastics covers are put on the dry trays which have a shelf life of about a year. If the apparatus of the invention is associated with a conveyor for automatic operation, the conveyer may lead directly to a continuous tunnel-type dry-freezing plant. The trays can be made of glass which is impervious to gases and not objectionable in any other way, but preferably an impervious plastics material not having any other deleterious property is used.

I claim:

1. An apparatus for dispensing liquid to wells of a multi-well tray, the apparatus comprising liquid source means, an array of pumps, means connecting said liquid source means to said pumps, means for operating said pumps to cause each to supply a predetermined quantity of liquid from said source means, a two-dimensional array of nozzles, means connecting said pumps to said nozzles for delivery of said predetermined quantities thereto, a support for supporting a multi-well tray, and means for relatively moving said array of nozzles and said support between a first position in which said support and said array of nozzles are spaced apart to permit loading and unloading of a tray on and off said support, and a second position in which said support and said array of nozzles are in proximity, whereby each well of a tray on the support is located to receive the predetermined quantity of liquid from a respective one of said nozzles, in which each of said nozzles has a mouth shape such that the delivery thereto of the predetermined quantity of liquid causes a suspended drop of said liquid to be retained at said nozzle, and in which said relative movement of said tray support from its first position to its second position causes each drop to be dispensed to the associated well by contact between said well and said drop.

2. The apparatus of claim 1 having means located below said array of nozzles guiding said support for substantially vertical movement, said means for relatively moving said array of nozzles and said support comprising rotatable eccentric roller means acting on the support.

3. The apparatus of claim 2 having a first shaft means carrying said eccentric roller means, second shaft means adapted to drive said pumps, drive means connecting said first and second drive means, and a power source for driving said first and second shaft means in co-ordination through said drive means.

4. The apparatus of claim 1 in which said array of pumps comprises a plurality of rows each of a plurality of pumps, said apparatus including a pump shaft adapted to drive all the pumps of each row.

5. The apparatus of claim 4 having drive means linking said plurality of pump shafts and said means for relatively moving said array of nozzles and said support.

6. The apparatus of claim 1 in which each pump comprises a peristaltic pump having a length of compressible tubing, a plurality of freely rotatable rollers, means supporting said rollers to roll along said length of compressible tubing, support means backing the tubing, and means for selectively adjusting the relative position of said roller and said support means.

7. The apparatus of claim 6 in which said position adjusting means comprises spring means and means for adjusting the spring tension thereof for fine positional adjustment.

8. The apparatus of claim 1 having means for cylically driving said pumps and said support in co-ordination so that the predetermined quantity of liquid is dispensed from each nozzle during each cycle.

9. The apparatus of claim 1 in which said liquid source means comprises an array of liquid containers, said connecting means connecting each of said containers to a respective one of said pumps, whereby antibiotic liquids of different concentrations can be dispenses from different ones of the containers into different wells of a multi-well tray.

10. A method of dispensing liquid to wells of a multi-well tray, the method comprising the steps of relatively moving the tray and a two-dimensional array of nozzles from a first position, in which said tray and said array of nozzles are spaced apart to permit loading of the tray onto support means therefor, to a second position in which said tray and said array of nozzles are in proximity whereby each well of the tray is located in registration with a respective one of the nozzles, supplying a predetermined quantity of liquid from a respective one of an array of pumps to each of the nozzles so as to provide a droplet suspended thereon, transferring each droplet to its associated well by contact with the well when said tray and array of nozzles are moved to said second position, and stopping the pump and relatively moving the tray and the array of nozzles to the first position for unloading the tray from said support means.

11. The method of claim 10 in which the pumps supply an antibiotic liquid in different concentrations from respective containers thereof.

12. The method of claim 11 having the further step of dry-freezing the liquid received in the tray.

* * * * *